US005392760A

United States Patent [19]

Binzer

[11] Patent Number: 5,392,760

[45] Date of Patent: Feb. 28, 1995

[54] DIRECT VENT FIREPLACE

[76] Inventor: Lothar Binzer, 12091-88 Avenue, Surrey, British Columbia, V3W 3J5, Canada

[21] Appl. No.: 954,788

[22] Filed: Sep. 30, 1992

[51] Int. Cl.[6] ..... F23L 17/00

[52] U.S. Cl. ..... 126/85 B; 126/83; 126/200; 126/304 A; 126/521; 126/531; 126/92 AC; 431/125

[58] Field of Search ..... 126/531, 512, 91 R, 126/92 A, 92 AC, 92 R, 515, 83, 500, 80, 85 B, 304 A, 92 C, 85 R, 86, 200, 190; 431/125, 12, 2; 454/35, 36

[56] References Cited

U.S. PATENT DOCUMENTS

| | | | |
|---|---|---|---|
| 2,926,657 | 3/1960 | Ford | 126/512 |
| 3,489,135 | 1/1970 | Astrella | 126/200 |
| 3,550,579 | 12/1970 | Baker | 126/85 B |
| 3,552,377 | 1/1971 | Hodges | 126/85 B |
| 3,614,949 | 10/1971 | Goodgion | 126/85 B |
| 3,741,194 | 6/1973 | Herron | 126/85 B |
| 4,099,511 | 7/1978 | McIntire et al. | 126/190 |
| 4,259,941 | 4/1981 | Gerdes | 126/523 |
| 4,649,903 | 3/1987 | Takeuchi et al. | 126/653 |
| 4,793,322 | 12/1988 | Shimek et al. | 126/85 B |
| 4,817,585 | 4/1989 | Craver | 126/200 |
| 4,852,584 | 8/1989 | Shimek et al. | 126/85 B |
| 4,940,042 | 7/1990 | Moore, Jr. et al. | 126/344 |
| 4,976,253 | 12/1990 | Beal et al. | 126/512 |
| 5,092,313 | 3/1992 | Blackburn et al. | 126/85 B |
| 5,261,389 | 11/1993 | Trieb | 126/85 B |

FOREIGN PATENT DOCUMENTS

| | | | |
|---|---|---|---|
| 2650371 | 2/1991 | France | 126/512 |
| 210117 | 7/1960 | Germany | 126/85 B |
| 2528350 | 7/1976 | Germany | 126/85 B |
| 102119 | 4/1991 | Japan | 126/304 A |
| 847141 | 9/1960 | United Kingdom . | |

*Primary Examiner*—James C. Yeung
*Attorney, Agent, or Firm*—Flehr, Hohbach, Test, Albritton & Herbert

[57] ABSTRACT

A gas fireplace comprising a housing adapted to be located in a building. There is a first conduit in the housing to act as an air inlet. In insert is received within the housing. A second conduit in the insert aligns with and is received by the first conduit. The invention permits the construction of a gas fireplace in two stages, a first stage in which the housing is built into the building and a second, subsequent to all building activity, in which the insert is received within the housing.

10 Claims, 19 Drawing Sheets

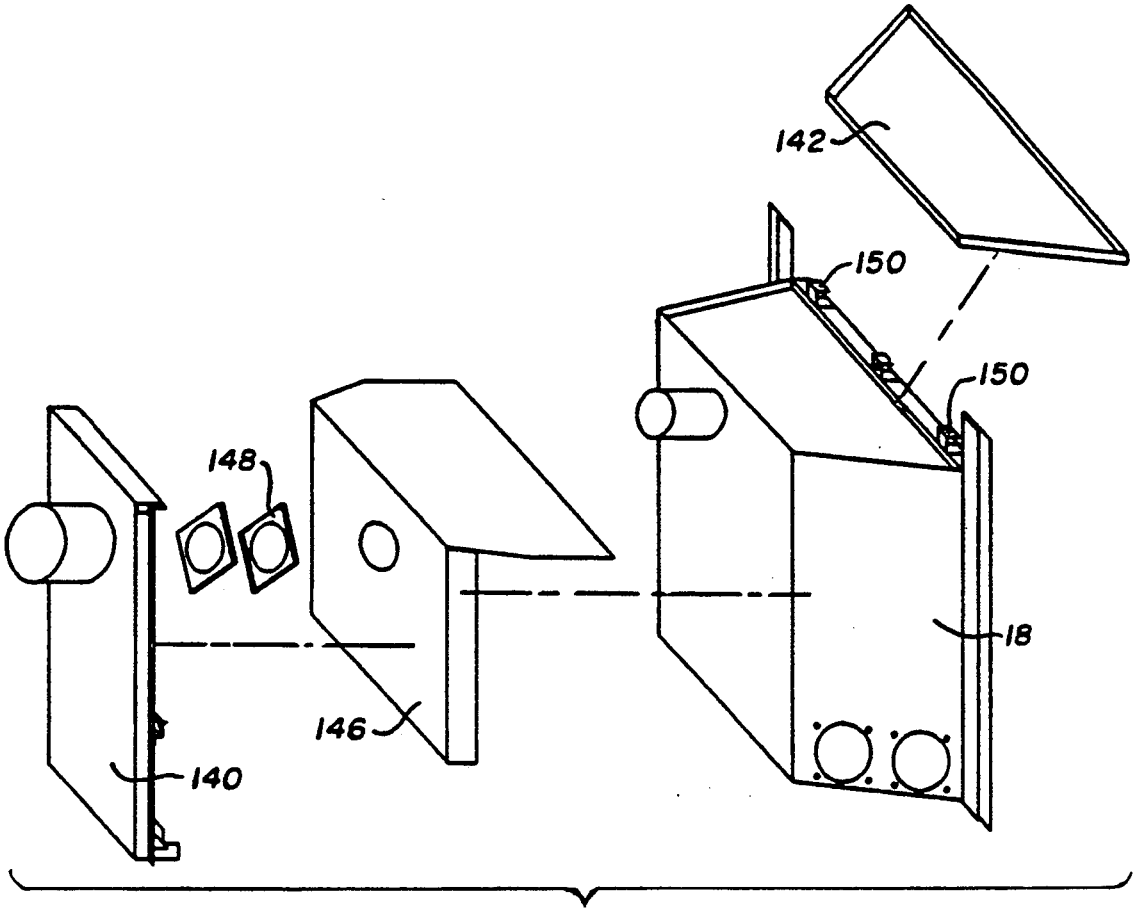
Fig. 8.
Fig. 8A.
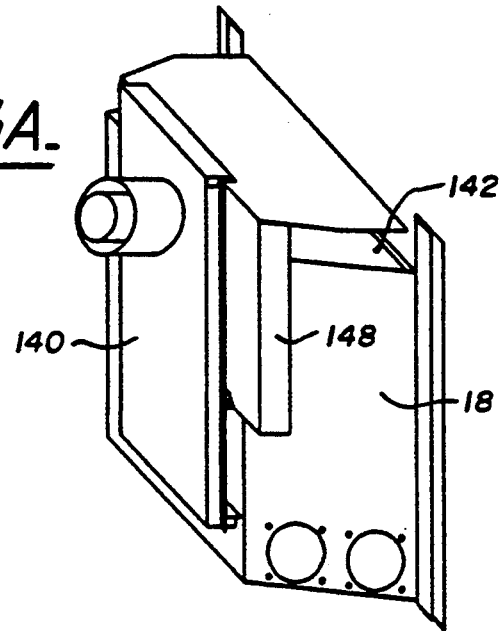

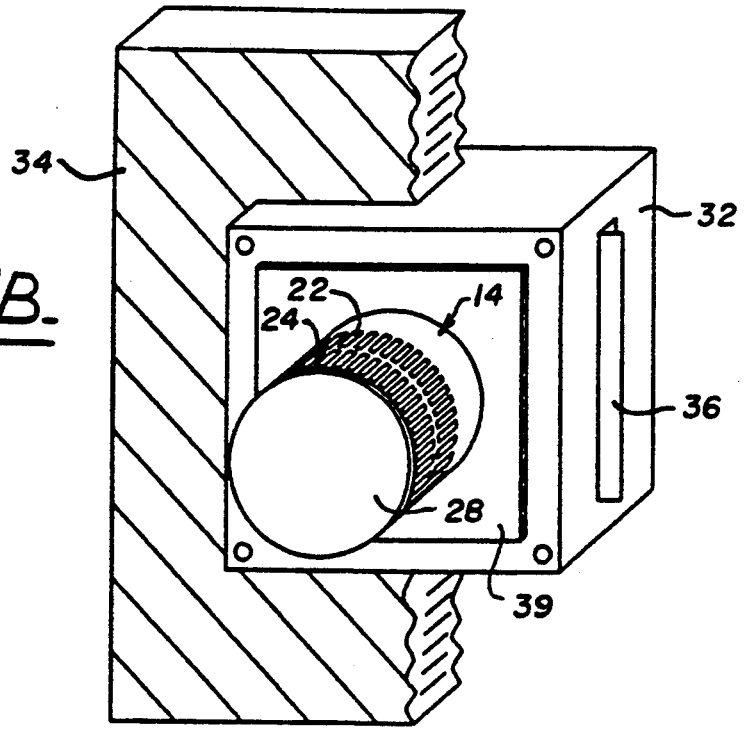
Fig. 9B.
Fig. 10.
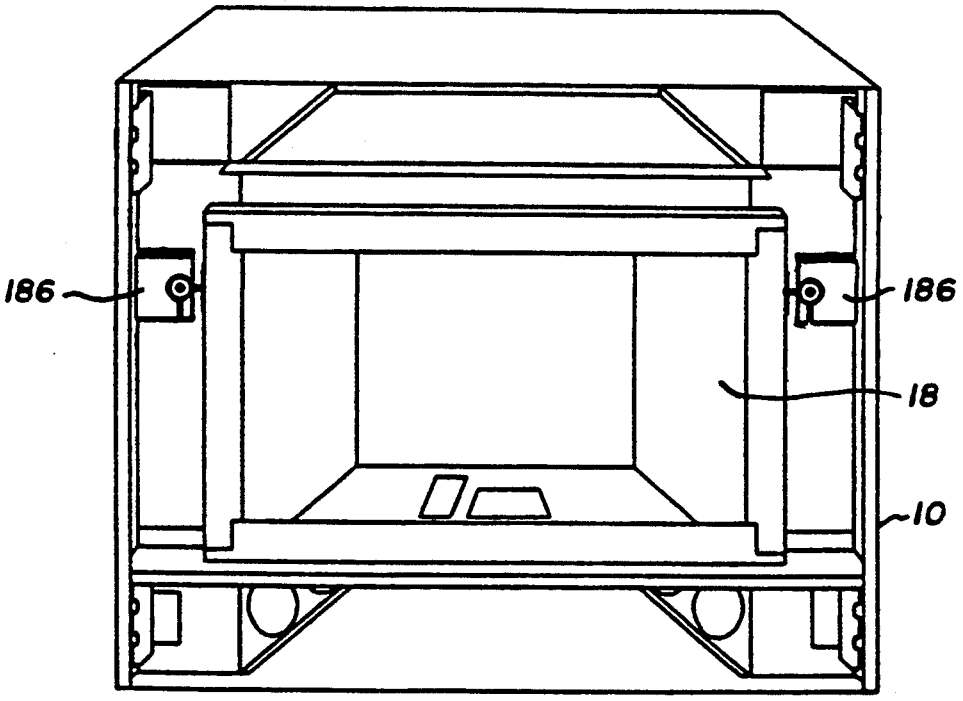

DIRECT VENT FIREPLACE

FIELD OF THE INVENTION

This invention relates to a gas fireplace.

DESCRIPTION OF THE PRIOR ART

Gas fireplaces are well known and of increasing value. There are huge reserves of natural gas in North America and in Europe. Furthermore, there are plentiful supplies of propane, usually as a by-product of gas cracking. Both these gases burn with high efficiency and low pollution. As a result, there is an increasing tendency to use them in place of the prior art coal burning fires popular in Europe, and the wood burning fires popular in North America.

Typically these prior art gas fireplaces include an insert, easily received in a building, with a gas inlet to an inner closed chamber. Gas and air supply to the chamber is provided, typically by concentric ducts. The inlet air comes in the outer duct and the exhaust passes out of the building through the inner duct. By this means the air to be burned is warmed by the exhaust gases and the exhaust gases are cooled and insulated from the building structure. It is common to use a heat exchanger at the top of the fireplace so that air from the room can be fed through the bottom of the insert, around the closed chamber, through the heat exchanger and out into the room. It will be appreciated, and is also a marked advantage over the prior art coal and wood fires, that room air, warmed at considerable expense, is not fed up a chimney to atmosphere but is recirculated in the room. Air for combustion of the fire is fed separately and does not come into or from the room. As a result there is a great deal more heat available.

Despite the many excellent designs available in gas fireplaces, there is room for improvement. In particular the present invention is aimed to improve both the installation of gas fireplaces and the performance of those fireplaces, once installed.

SUMMARY OF THE INVENTION

Accordingly, and in its broadest aspect, the present invention is a gas fireplace comprising a housing adapted to be located in a building; a first conduit in the housing to act as an air inlet; an insert to be received within the housing; a second conduit in the insert to align with, and be received by, the first conduit; whereby the gas fireplace can be constructed by inserting the insert into the housing.

DESCRIPTION OF THE DRAWINGS

The invention is illustrated in the drawings in which:

FIGS. 8 and 8A are views similar to FIG. 7 through a rear vented fireplace;

FIGS. 9*a* and 9B are further views of FIG. 9;

FIG. 10 shows the insert in place in the housing;

DESCRIPTION OF THE PREFERRED EMBODIMENTS

Figure 1:
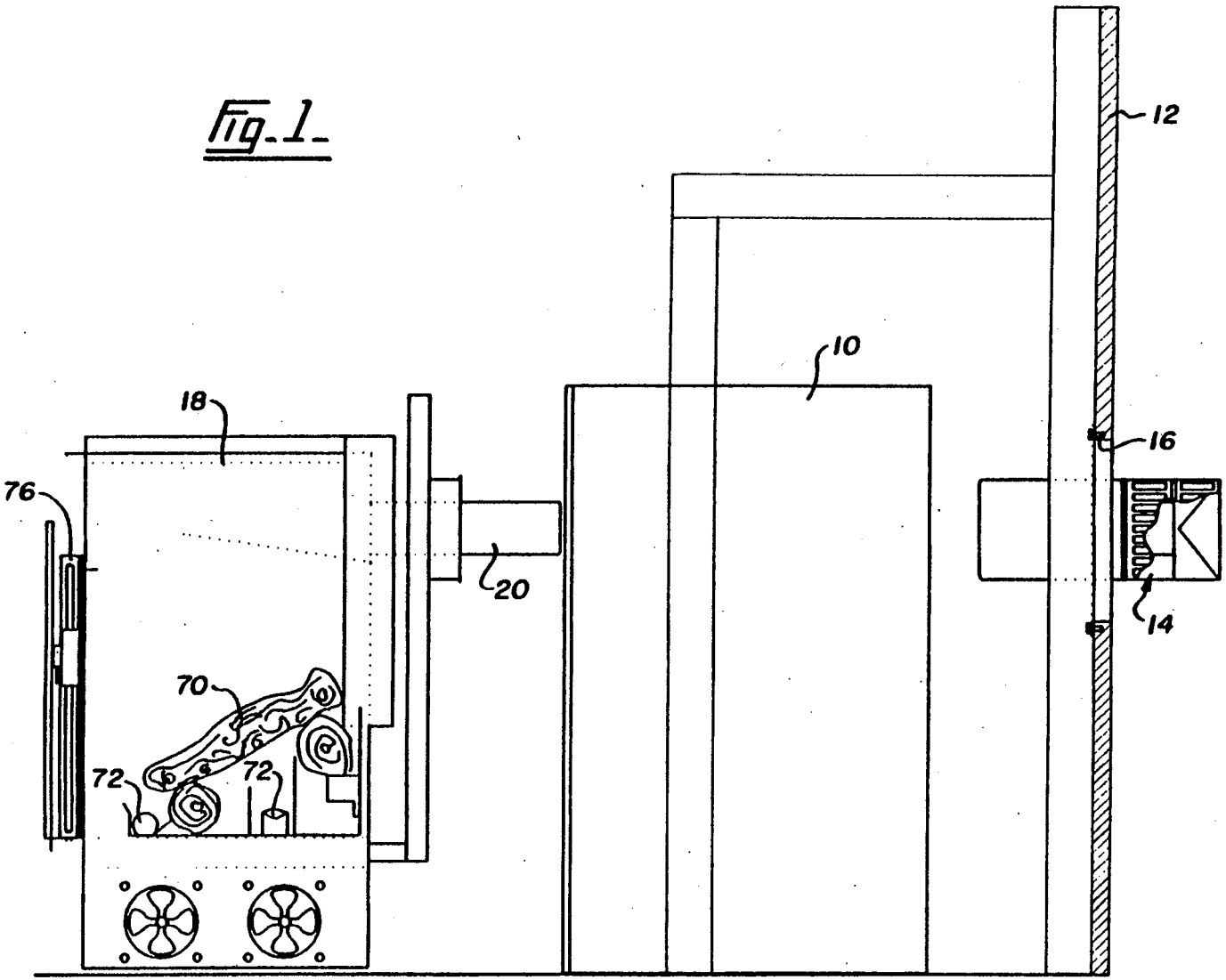
FIG. 1 is a general view of a gas fireplace according to the present invention.

Referring first to FIG. 1, the drawings show a gas fireplace comprising a housing 10 adapted to be located in a building. Only a wall 12 of the building is shown. There is a first conduit 14 in the housing 10 to act as an air inlet. The first conduit 14 extends through an opening 16 in the wall 12. There is an insert 18 to be received in the housing 10 and a second conduit 20 in the insert aligns with, and is received by, the first conduit 14.

The particular advantage of this structure is that the gas fireplace housing 10 and the insert 18 are separate entities.

The housing 10 can generally be used to receive inserts 18 of a range of sizes, as an economy of construction. As shown particularly in FIG. 1, but also in FIG. 9, the first conduit 14 comprises a cylinder having first 22 and second 24 groups of longitudinal openings at its outer end. The first and second conduits 14 and 20 are dimensioned so that the second conduit 20 extends to a point between the two groups of longitudinal openings 22 and 24. There is a conical closure 26 for the first conduit. The arrangement shows that outlet gases pass over the conical closure 26, through the second group of longitudinal openings 24 and the inlet gases pass through the first group of openings 22 into a space defined between the first and second conduits 14 and 20. The space is closed by gasket 30. Preferably there is flat end piece 28 for the conical closure 26 to reduce the accumulation of rubbish in the conical closure 26.

Figure 9A:
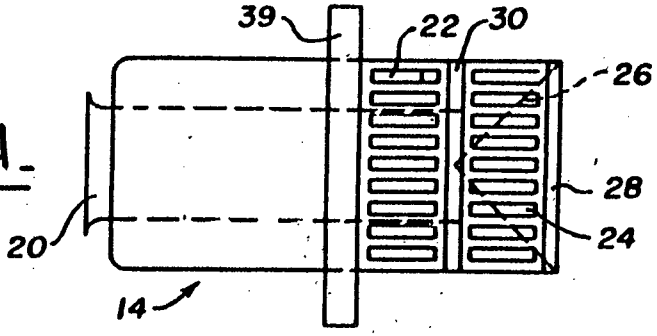
Figure 9:
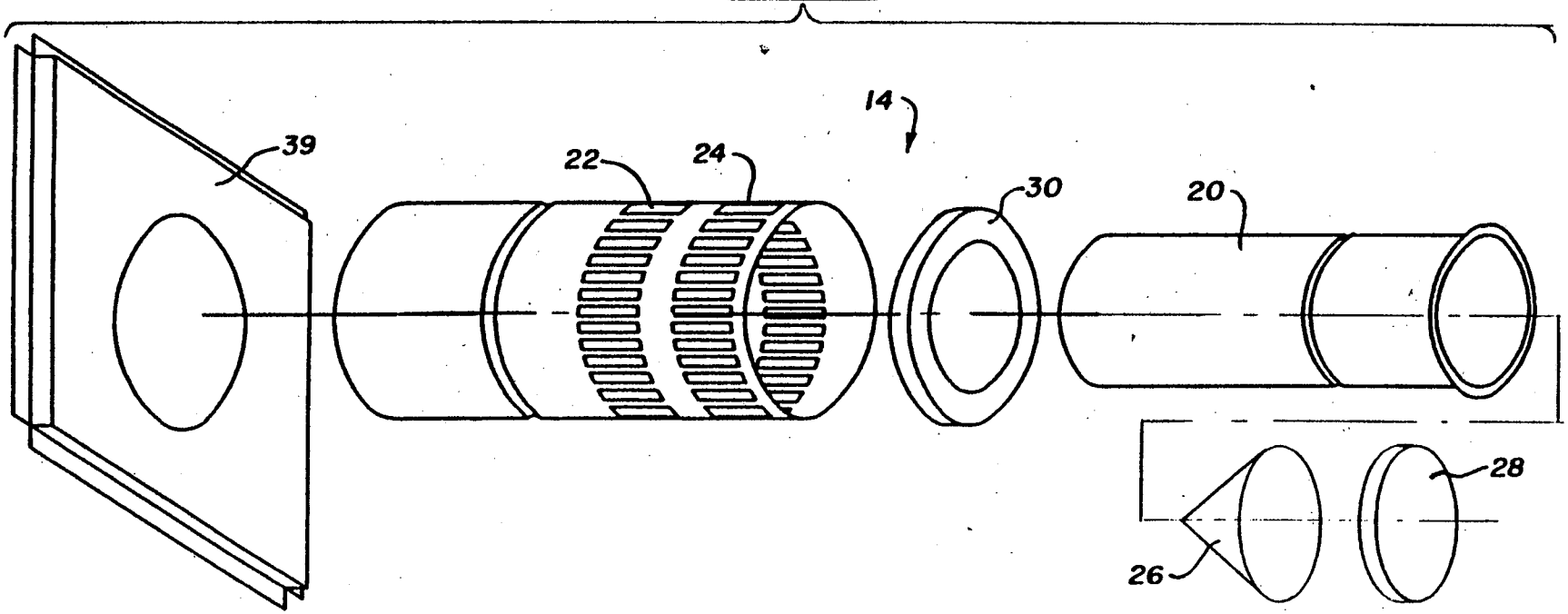
FIG. 9 is an exploded view of the gas outlet and inlet for the fireplace.

In a preferred embodiment, illustrated in FIG. 9B, the first conduit 14 is formed in a unit comprising a chamber 32 to receive the conduit 14 and to be received in a wall 34. There are means to attach the chamber 32 to the wall 34. In FIG. 9B the means comprise a simple flange 36 to be attached to, or moulded into wall 34. A first wall 39 of the chamber 36 is shown in FIGS. 9 and 9A.

Figure 18:
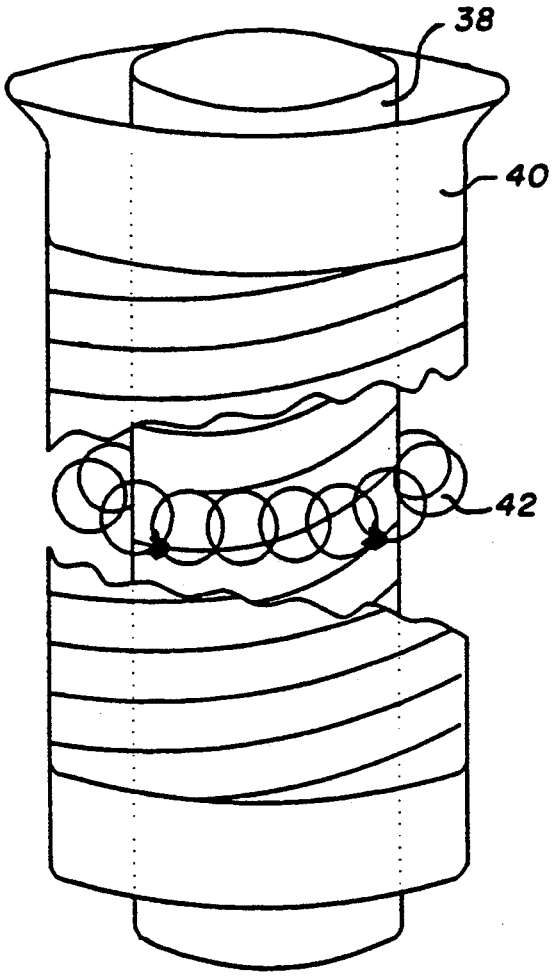
FIG. 18 illustrates means to maintain concentricity of the inlet and outlet conduits of the housing and insert.

FIG. 18 shows a further feature of the embodiment where concentricity of ducts 38 and 40, leading to the first and second conduits, is maintained by a coil 42. Concentricity is a desirable feature where twin ducts are used but the embodiment of FIG. 18 is normally only necessary with vertical chimneys as distinct from the horizontal chimney of FIG. 1. In vertical chimneys the distance involved can be quite substantial.

Figure 15:
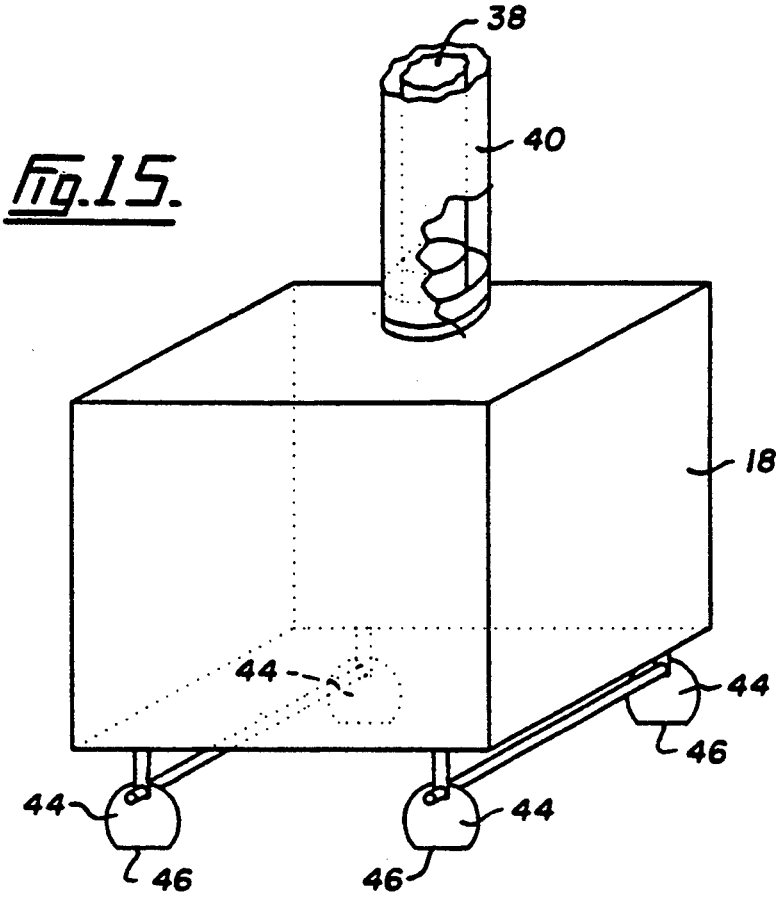
FIG. 15 illustrates means to position the insert relative to the housing to achieve alignment of the inlet and outlet conduits.

The insertion of the housing 10 and the insert 18 as separate entities means that there must be a means to align the insert 18 to ensure that the second conduit 20 aligns with the first conduit 14. This is particularly so with vertical chimneys. One means of achieving this is shown in FIG. 15 where eccentric wheels 44, having flats 46 are shown. In a first position, the insert 18 is pushed into place and the wheels 44 rotated to raise the insert 18 so that the second conduit 20 is forced upwardly into the first conduit 14 and raised further to engage ducts 38 and 40. The wheels 44 are then left with the flats 46 on the base of the housing to maintain position.

Figure 16:
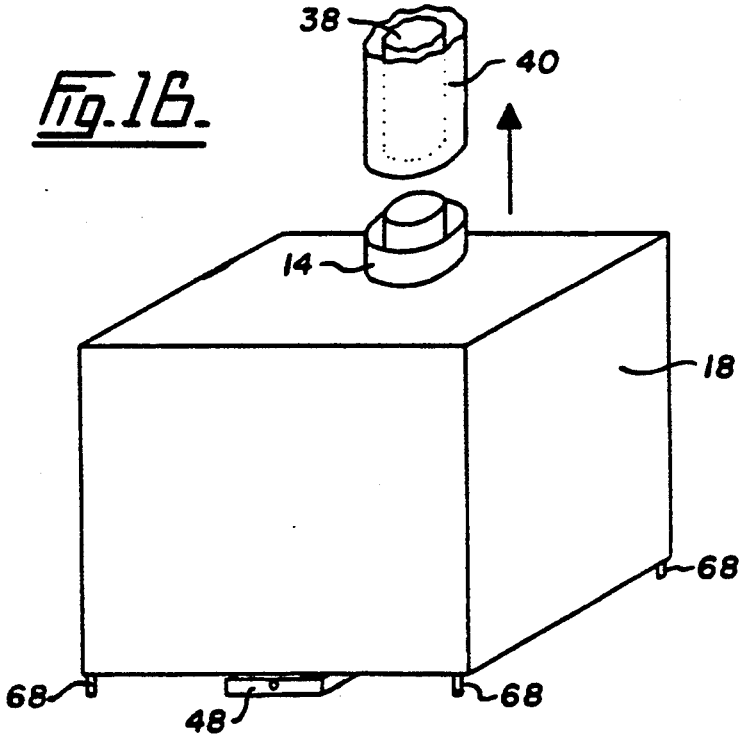
FIGS. 16 and 16*a* illustrate a variation of the positioning of the insert.
Figure 16A:
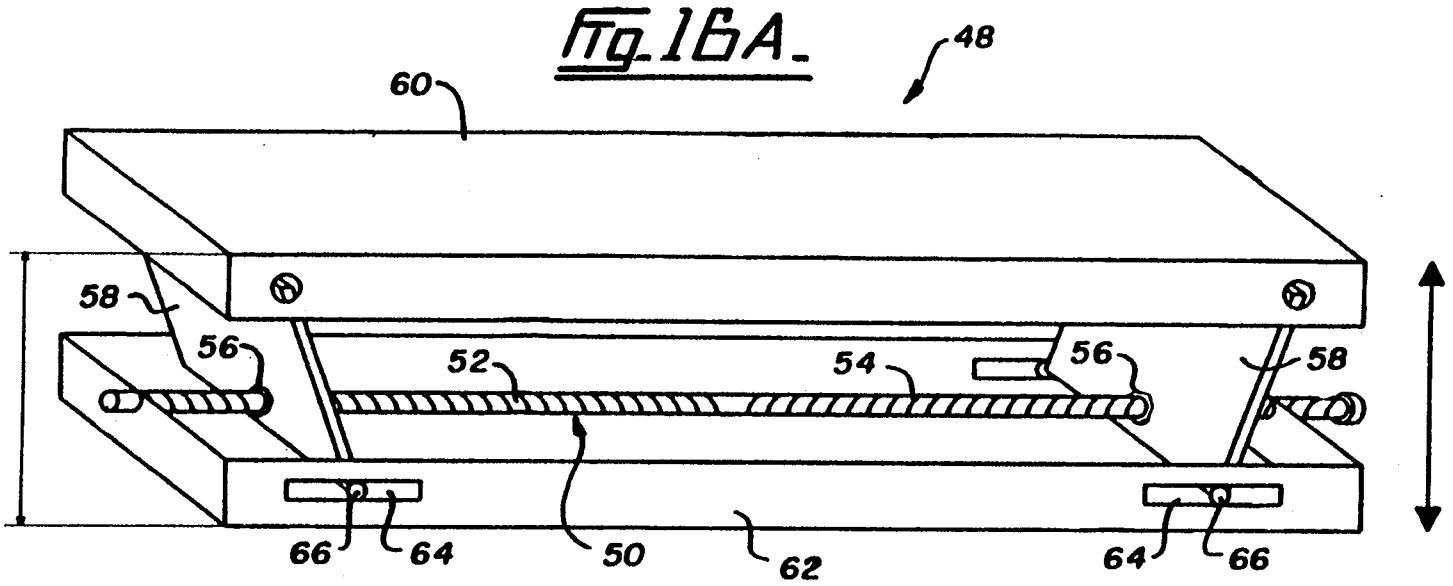

An alternative means is shown in FIGS. 16 and 16*a*. FIG. 16 shows the insert moved into position with a jack 48. FIG. 16*a* shows the jack to comprise a rotatable bar 50 having first 52 and second 54 threaded portions. The threaded portions engage in threaded openings 56 in legs 58 to an upper jacking plate 60. The jack has a bar 62 with slots 64 to receive studs 66 on the legs 58. Rotation of the bar 50 moves the jacking plate 60 upwardly and downwardly so that the insert can be moved to a position where the second conduit engages the first conduit of the housing. As shown particularly in FIG. 16 there are legs 68 which can move downwardly as the insert 18 is raised. The legs may, for example, be threaded so that as the jack is raised the legs 68 are threaded downwardly to ensure an even, permanent mounting for the insert relative to the housing. Once this position is secured, the jack 48 is removed.

Figure 2:
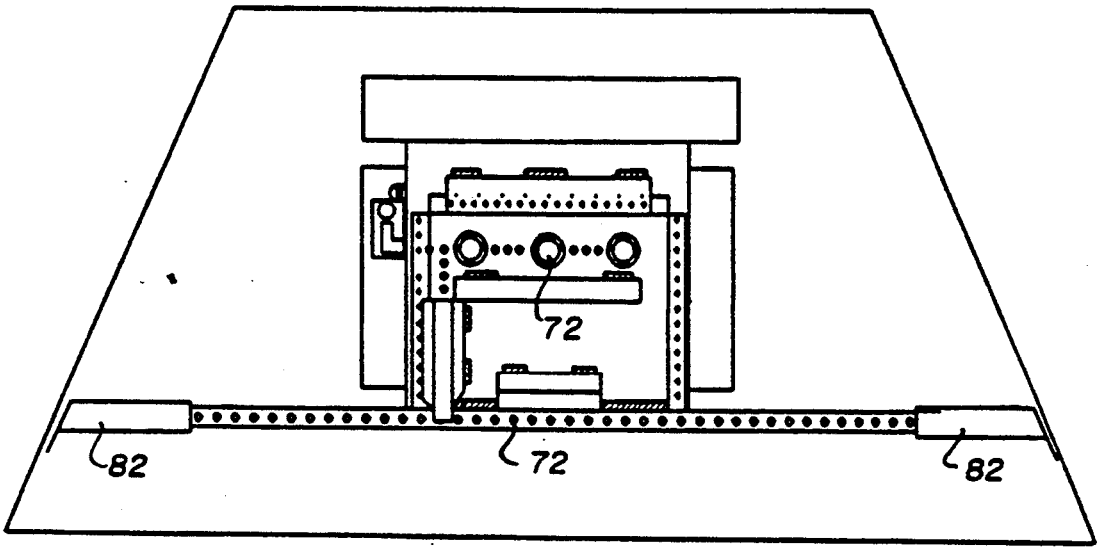
FIG. 2 illustrates the burner assembly of the fireplace of FIG. 1.

As in the prior art the gas fireplace of the present invention includes artificial logs 70, gas burners 72, an ignition system 74, a door 76 and a heat exchanger 78 to exchange heat between the room air and combustion products. The front gas burner is a tube, formed with openings 80 of pre-determined size, that extends across the front of the insert. In the illustrated embodiment, there are also rear burners 72 as shown particularly in FIG. 2. There is a conventional gas supply to the burner. Air to allow the combustion enters through the second or outer conduit 14. Typically there is a pilot light or piezo-electric system to allow igniting of the gas when required. As indicated above, the gas fireplace of the present invention permits the use of differing sizes of inserts with one housing. In these circumstances, the gas burner bar is provided with extensions 82, as shown in FIG. 2, which extend outwardly to locate the tube 72 relative to the insert. The extensions 82 receive the bar and are attached to the walls of the insert.

The gas burner is desirably associated with means to improve gas flame appearance. According to the present invention it has been found that a bar 84, shaped as shown in FIG. 3A with openings 86 along its upper edge and curved around the gas burner 72 is effective in providing a simulated coal or wood flame. In this regard, it is considered good commercial practice to simulate the flame of coal or wood. Gas tends to burn with a clear blue, almost invisible flame and ceramic artificial logs are one means in the prior art of attempting to simulate a wood fire. However, the bar 84 acts further to disrupt the flame travel and provides excellent simulation of a wood flame.

Figure 17:
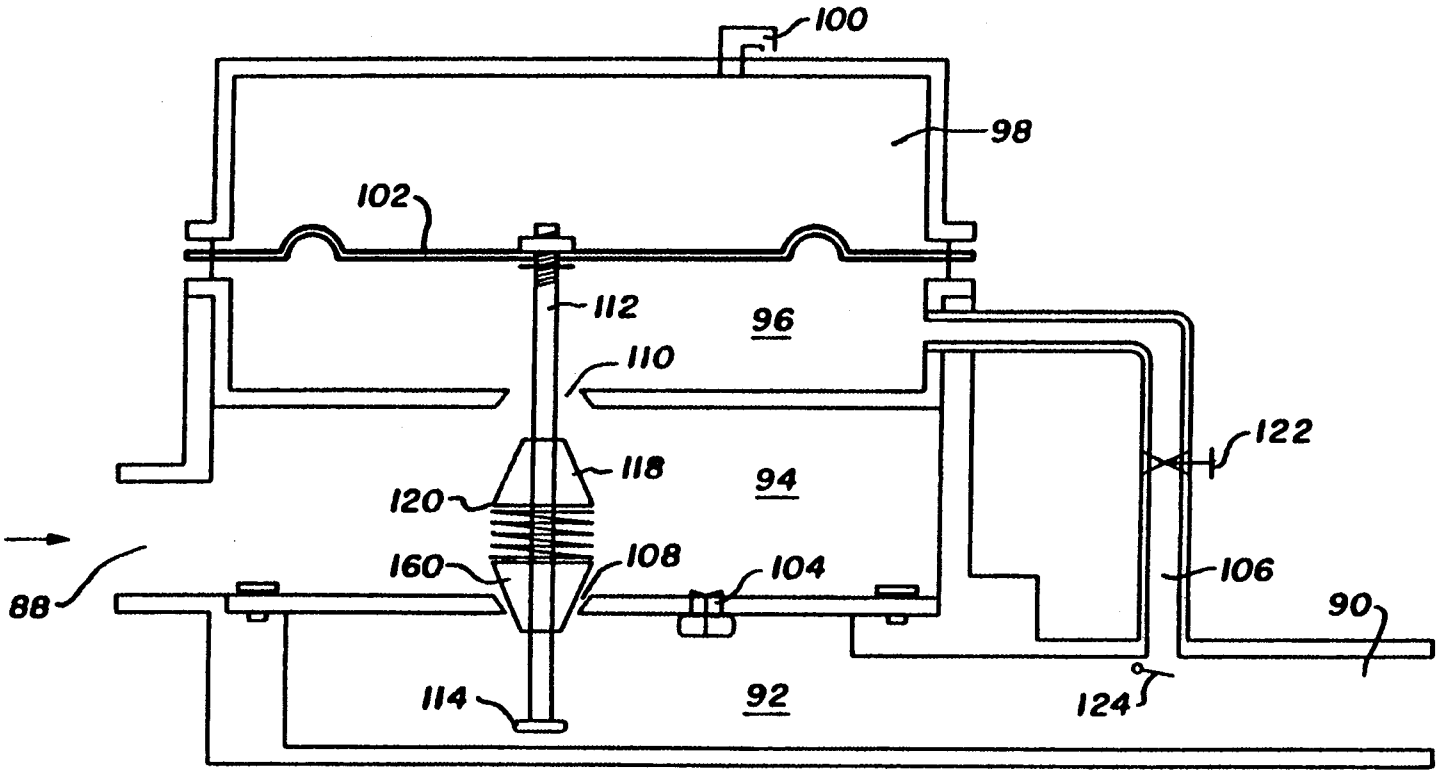
FIG. 17 is a schematic view of a means to vary flame height.

In this regard, a particularly preferred way of varying the flame pattern is shown in FIG. 17 which can be used in conjunction with the bar shown in FIG. 3A and operates by varying the gas supply to the burner. FIG. 17 shows diagrammatically a valve body having an inlet 88 and an outlet 90 for gas. There are first 92, second 94, third 96 and fourth chambers 98 and an air bleed 100 from the fourth chamber 98. There is a diaphragm 102 between the third and fourth chambers and a constant gas feed 104 from the second chamber 94 to the first chamber 92 to the gas outlet 90. There is a gas bleed 106 from the third chamber 96 to the first chamber 92 and then to the gas outlet 90. There is a first opening 108 between the first and second chambers and a second opening 110 between the second and third chambers. A valve stem 112 is mounted on the diaphragm 102 and extends through the first and second openings 108 and 110. There is flange 114 at the distal end of the stem 112 and first 116 and second 118 valve members on the stem 112. The first valve member 116 controls the first opening 108 and the second valve member 110 controls the second opening 110. There is a spring 120 urging the first and second valve members apart.

At the start, gas enters through the inlet 88, into the second chamber 94, through the constant gas feed 104 to the first chamber 92 to the burner through the outlet 90. This feed is sufficient to maintain a low flame. As a result of this relatively low volume of feed, gas pressure builds up in the second chamber 94 and in the third chamber 96 which is in communication with the second chamber 94 through the second opening 110. Under the influence of this pressure, the diaphragm 102 is raised. Air passes from the fourth chamber 98 through the bleed 100. Just before the second valve member 118 contacts the second opening 110, the valve flange 114 acts to raise the first valve member 116 to allow gas to pass from the second to the first chamber, through the first opening 108. There is thus a marked increase in the gas flow to the first chamber 92 and thus to the outlet 90 to increase flame height. With the second valve member 118 closing, second opening 110 gas bleeding from the third chamber 96 through the gas bleed 106 reduces pressure in the third chamber 96 which is, of course, closed from communication with the second chamber 94. As a result, the diaphragm moves downwardly to open again the second opening 110 and close the first opening 108 thereby reducing gas flow to the burner and producing a low flame. Gas flow through the gas bleed 106 may be regulated by a valve 122 and a check valve 124 may also be used at the outlet of the bleed 106 to the burner. Using the valve of FIG. 17, a rapid oscillation of the flame with increasing and decreasing gas supply is achieved.

Construction of the gas fireplace of the present invention is shown in a number of drawings. FIG. 2 shows the base plate and the position of the gas bar, burners and other conventional pieces of equipment on the base plate, for example, the igniters.

Figure 3:
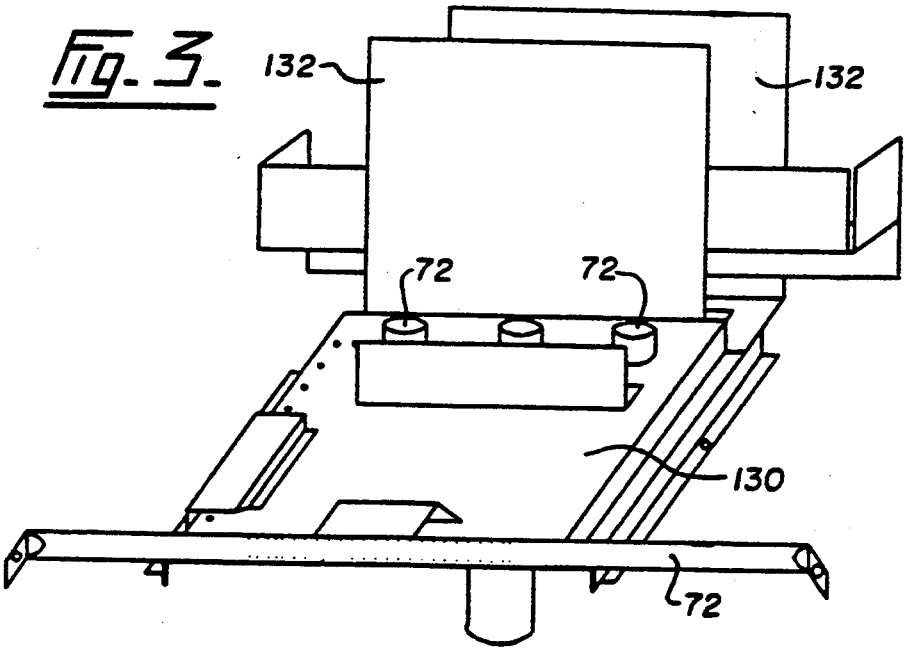
FIG. 3 is an isometric view of the burner assembly of FIG. 2.
Figure 3A:
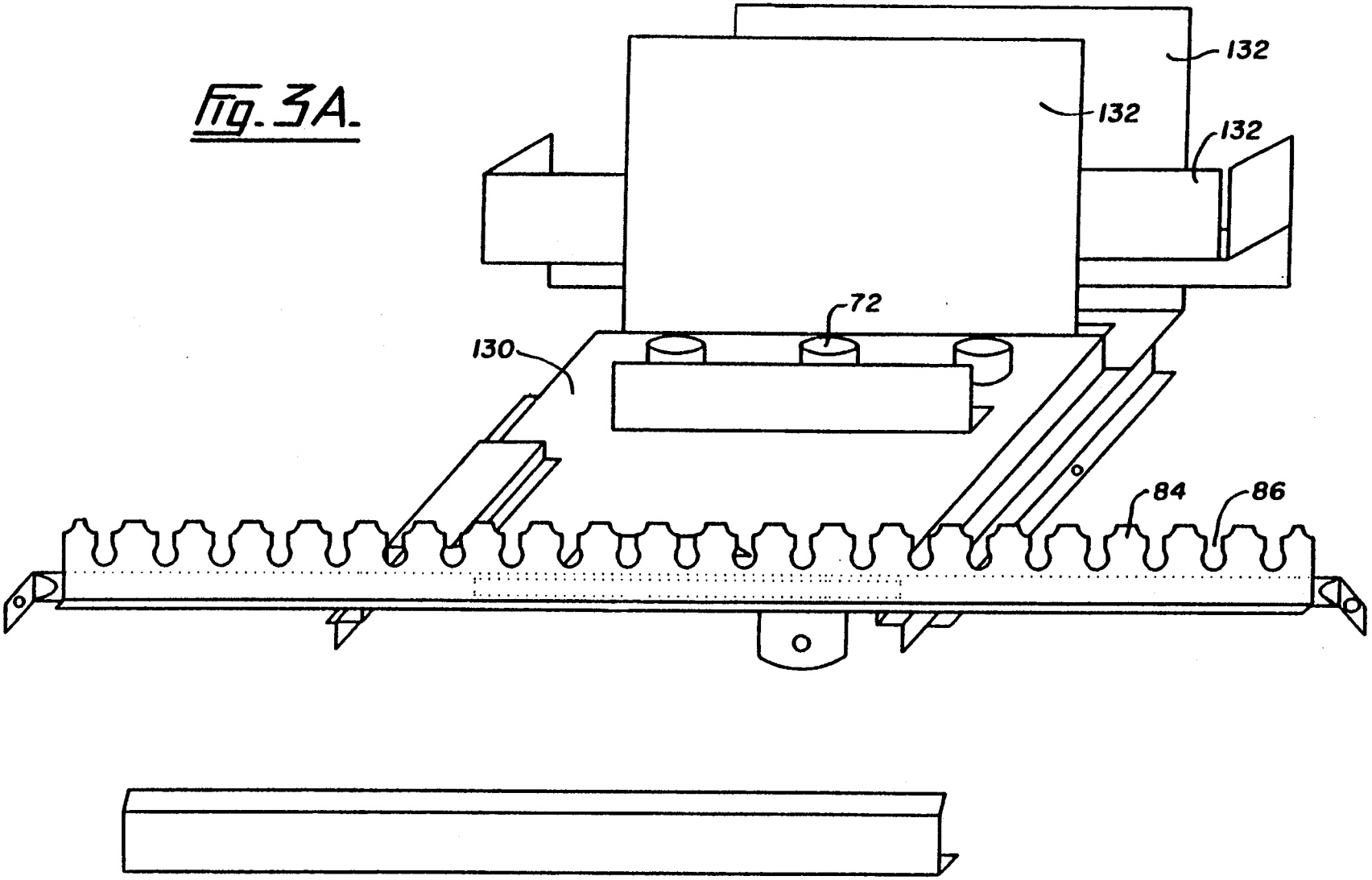
FIG. 3A illustrates means to shape the flame.
Figure 5:
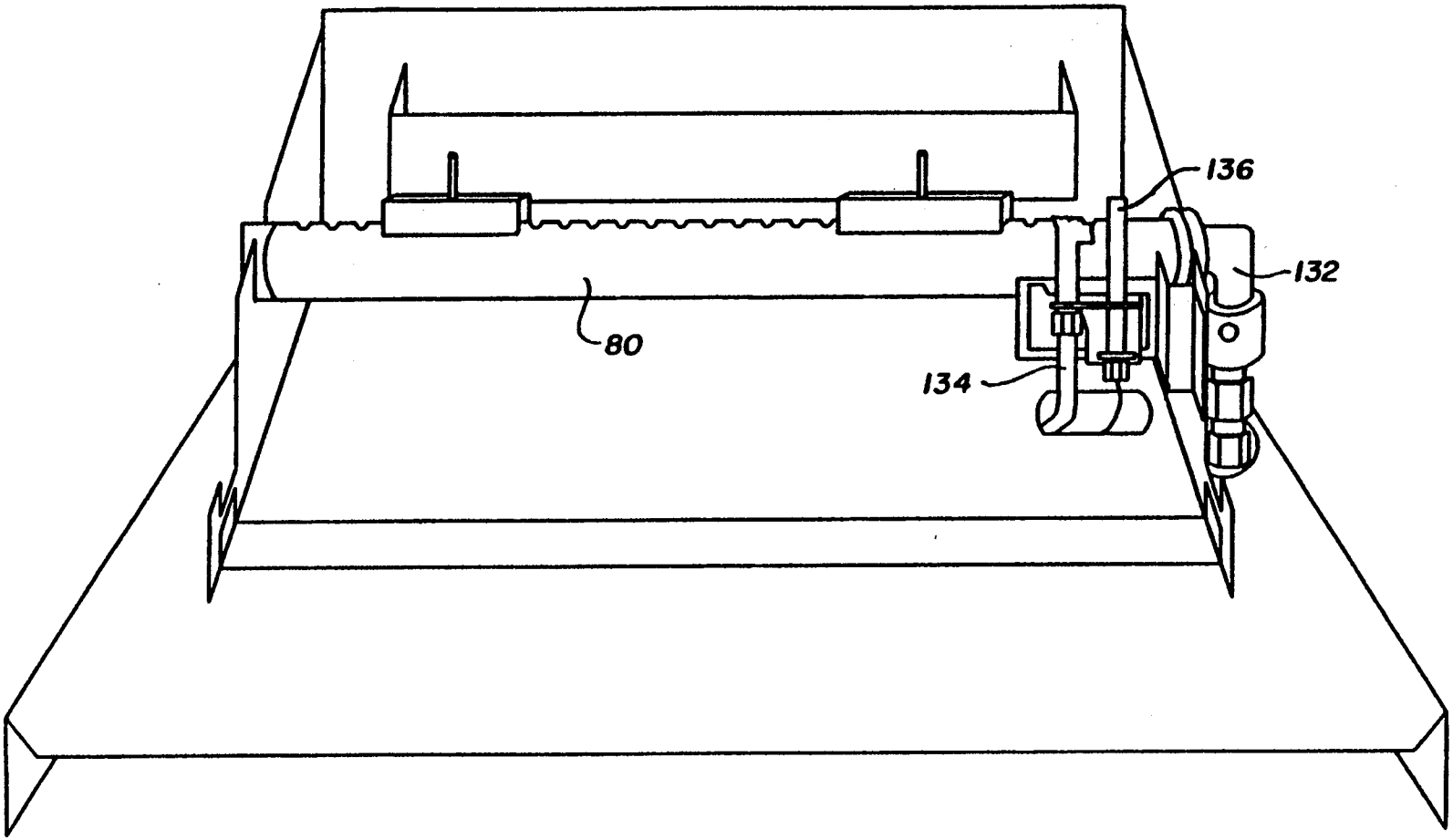
FIG. 5 shows the assembled burner construction.

FIG. 3 and 3A show the simple construction of the base and back of the insert comprising pre-fabricated metal sheets which are pre-fabricated, typically by punching, and indexed to fit together with a series of slots and pins. There is a base member 130 and back deflector sheets 132. FIG. 5 shows the burner 80, gas supply 132 and ignition 134. These may be standing pilots or a piezo-electric arrangement is shown at 136.

Figure 6:
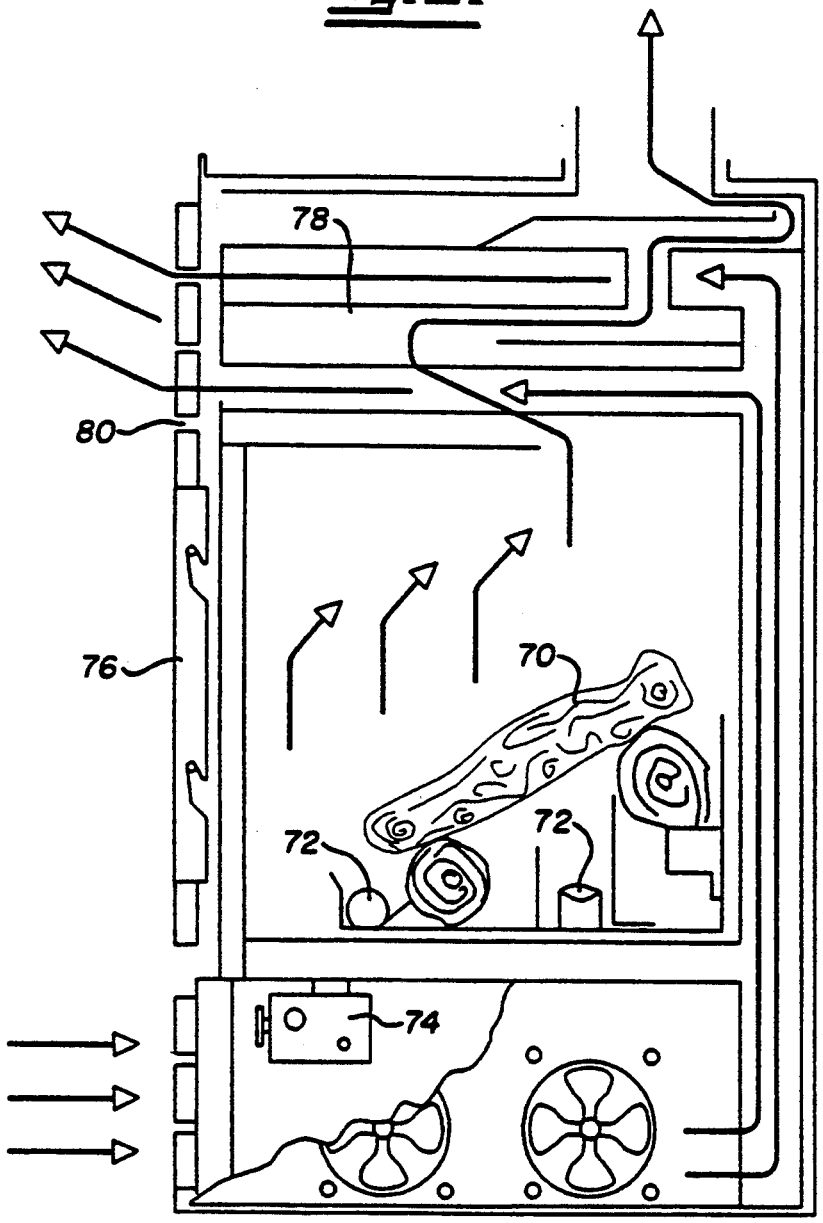
FIG. 6 is a side elevation showing gas flow in the burner of the present invention.

FIG. 6, as indicated above, shows the air travel through-out the fireplace, particularly the ability to exchange heat between the combustion products and the air in the room. Fans 138 force the room air through the heat exchanger 78 and back into the room. Such an arrangement is conventional.

Figure 7:
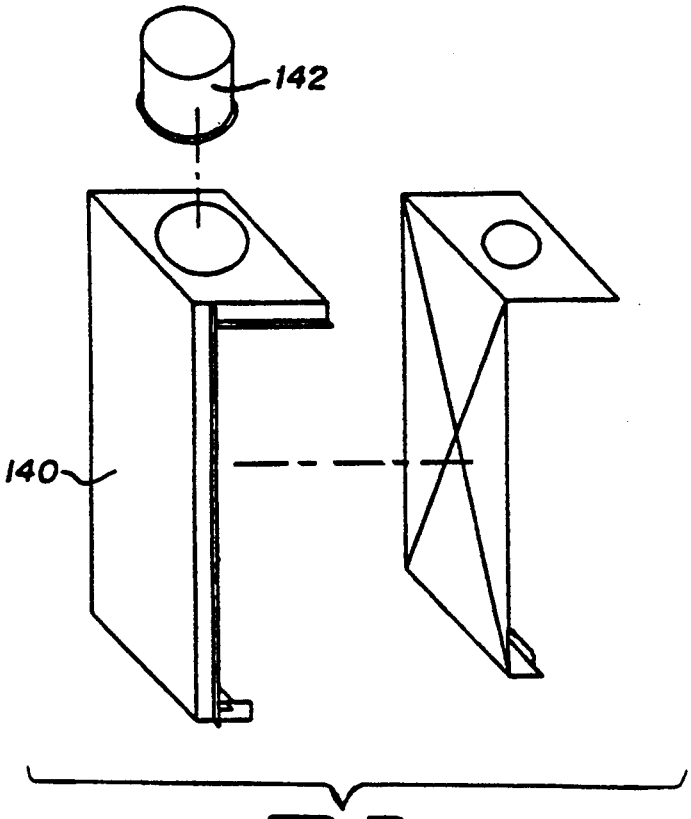
FIG. 7 is an exploded view of the air supply to the burner.

FIGS. 7 through 8A illustrate the warming of incoming air, that is air to be combusted, prior to its introduction into the insert 18. As shown in FIG. 7 a pathway 140 is constructed with an inlet 142. The combustion air, moving down through the outer conduit passes over the insert, where burning is taking place, prior to entering the insert to allow combustion. FIG. 7B illustrates the use of heat exchanger tubes 144 used in the heating of the room air and the fact that the inlet air, that is air to be combusted, passes through the chamber 140, shown exploded from the inserts 18 in FIG. 7B, and the use of a top piece 142, with a gasket member 144 formed on it.

Figure 7A:
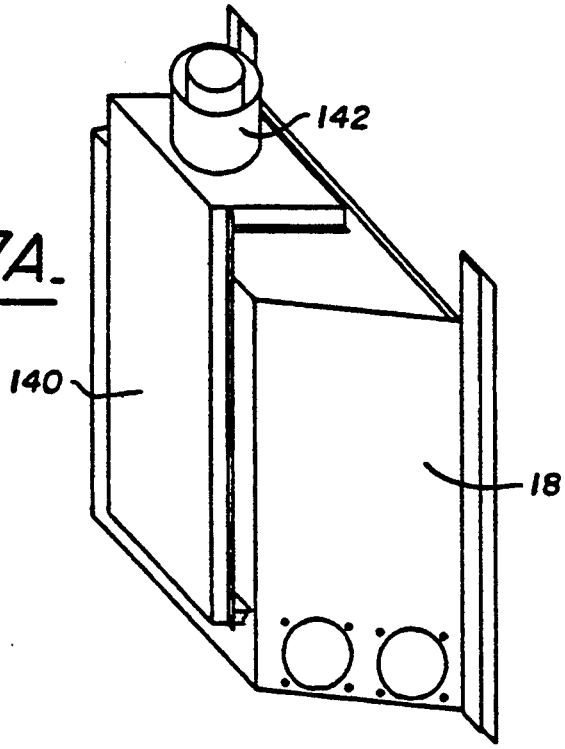
FIG. 7A shows the air supply of FIG. 7 in place in a housing.
Figure 7B:
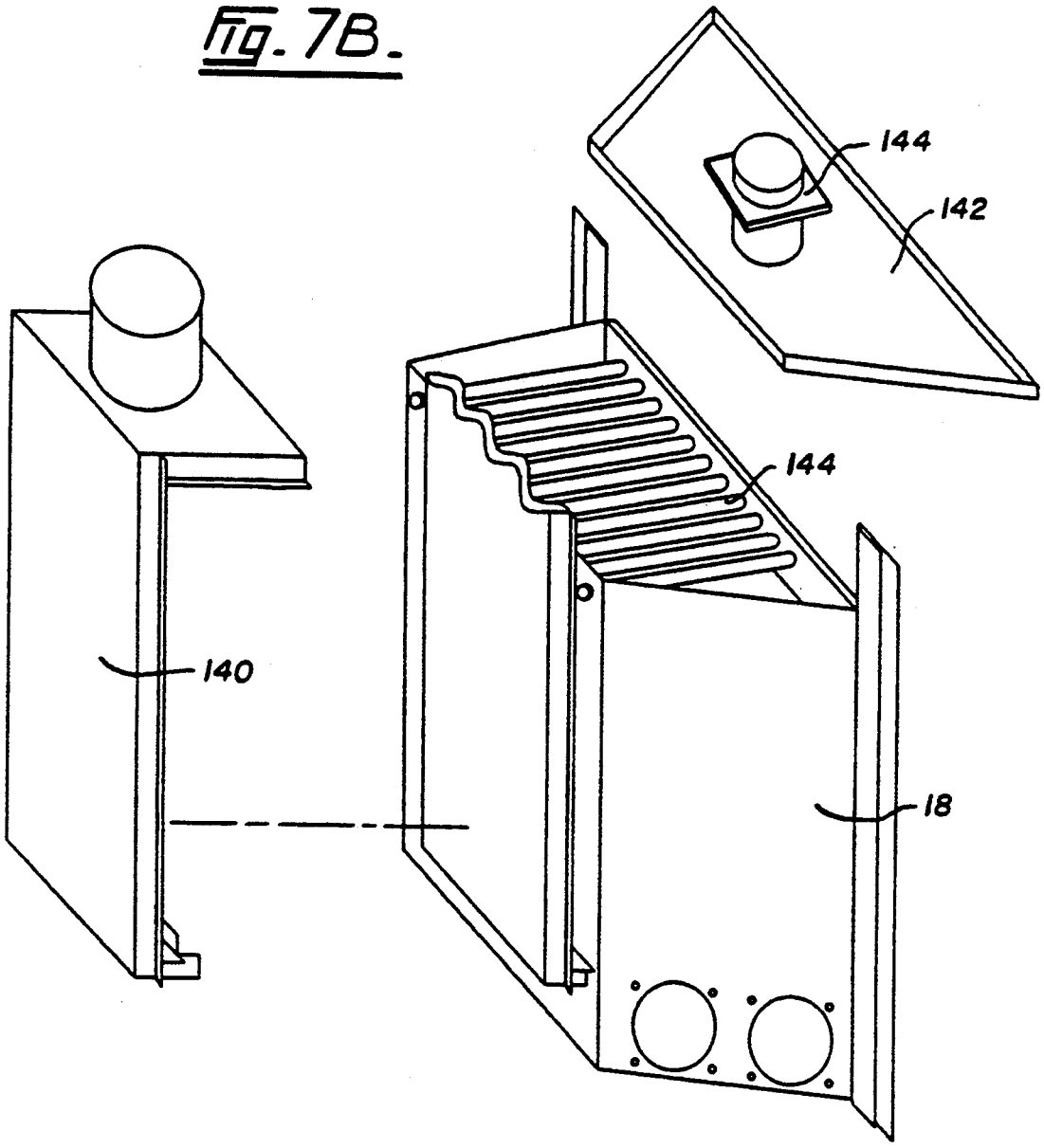
FIG. 7B is a partially sectioned elevation showing the heat exchanger.

It will be noted that FIGS. 7, 7A and 7B both use an upper or vertical chimney. FIGS. 8 and 8A show the use of horizontal chimneys. This latter arrangement includes an additional chamber member 146 and gaskets 148, that fit on the inner conduit between rear chambers 140 and insert 18. Clips 150 are to receive the decorative surround, common on fireplaces. Again, inlet air is heated prior to combustion.

FIG. 10 illustrates the insert 18 in position in the housing 10. The door of the unit is not present. Locks 152 are shown. Again clips 154 receive the trim members and the air chambers, through which air is passed, are shown.

Figure 10A:
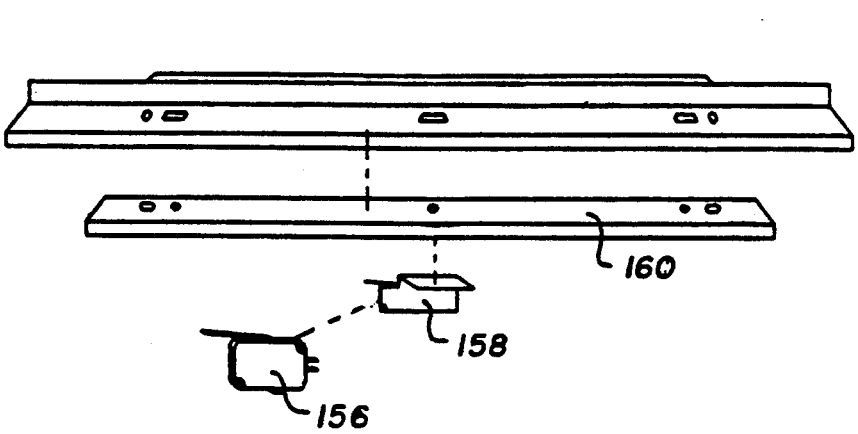
FIGS. 10*a* and 10*b* show details of FIG. 10.
Figure 10B:
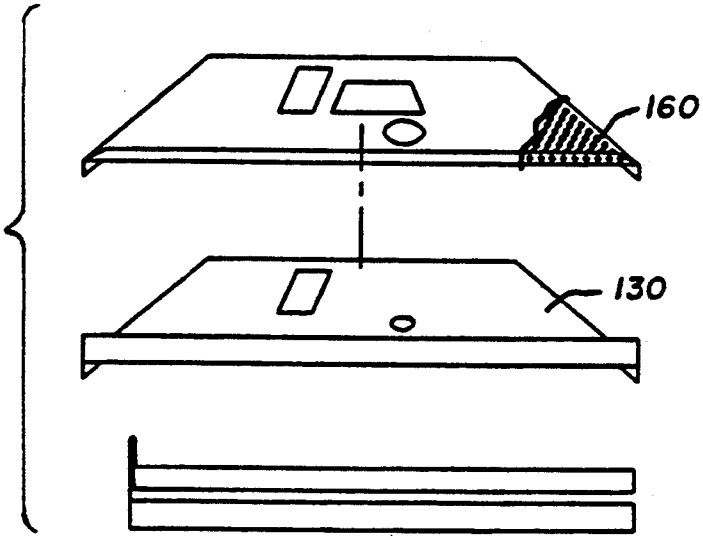

FIG. 10A shows a micro-switch 156, attached to bracket 158 attached in turn to lower member 160. A feature of the fireplace of the present invention as discussed below, is that the door may be removed and the micro-switch 156 ensures that gas can not be fed when the door is removed. FIG. 10B illustrates the use of a porous base plate 160 which spreads all the combustion air uniformly prior to combustion with the natural gas or propane, used as fuel. This ability prevents hot spots and poor mixing of air with the fuel. The screen is attached to base plate 130 by spot welding. Combustion air is fed between the plates through, for example, the ducting shown in FIGS. 7 and 8.

The location of the burners and gas supply and pilot control is conventional.

Figure 11:
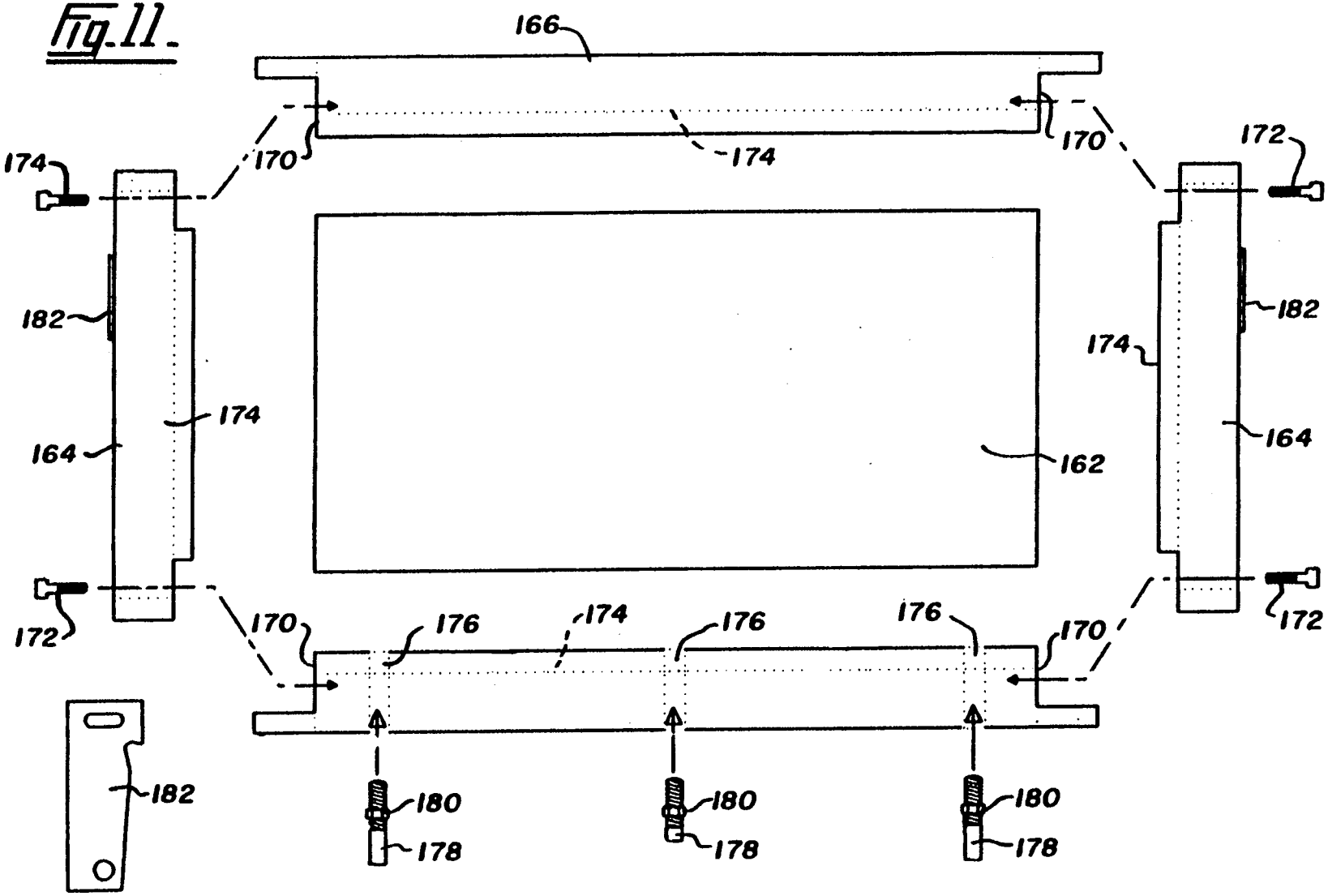
FIG. 11 is an exploded view of the door assembly.
Figure 12:
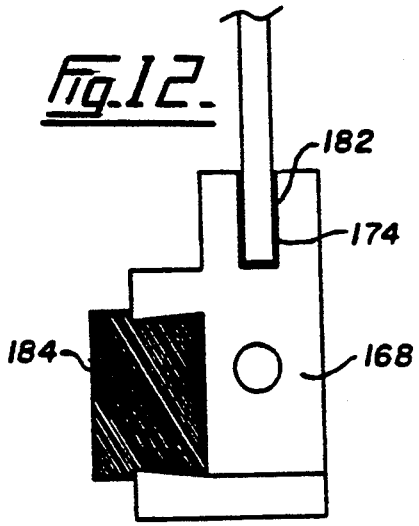
FIG. 12 is a detail of FIG. 11.

FIG. 10 shows that the door may be removed completely and easily. The structure of the door is shown in FIG. 11. The door comprises a central, typically silica, panel 162 with side pieces 164 and top 166 and bottom 168. The side pieces 164 are secured in threaded openings 170 in the top and bottom using screws 172. As shown particularly in FIG. 12, a channel 174 is defined in both the top, bottom and side pieces to receive the silica glass 162. Furthermore, the bottom 168 is provided with threaded openings 176 that receive screws 178 including lock nuts 180. A silicone gasket 182 is present, as shown in FIG. 12. The door assembly is held together by the screws. The silica panel 162 is located securely in the door by tightening in the screws 168 and locking them in position with the lock nuts 180.

The door is secured by brackets 182, one of which is shown in FIG. 11. The brackets are shown in position on the side members of the door.

As shown particularly in FIG. 12 there is a large silicone gasket 184 in the door frame that abuts the fireplace to make the door entirely gas-proof.

The use of seals means that the door can expand rapidly under heat.

Figure 13A:
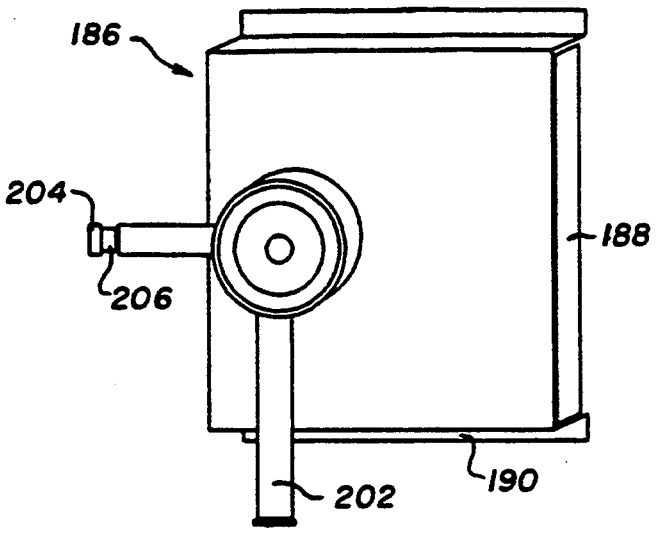
FIGS. 13 and 13*a* show the lock assembly for the door.
Figure 13:
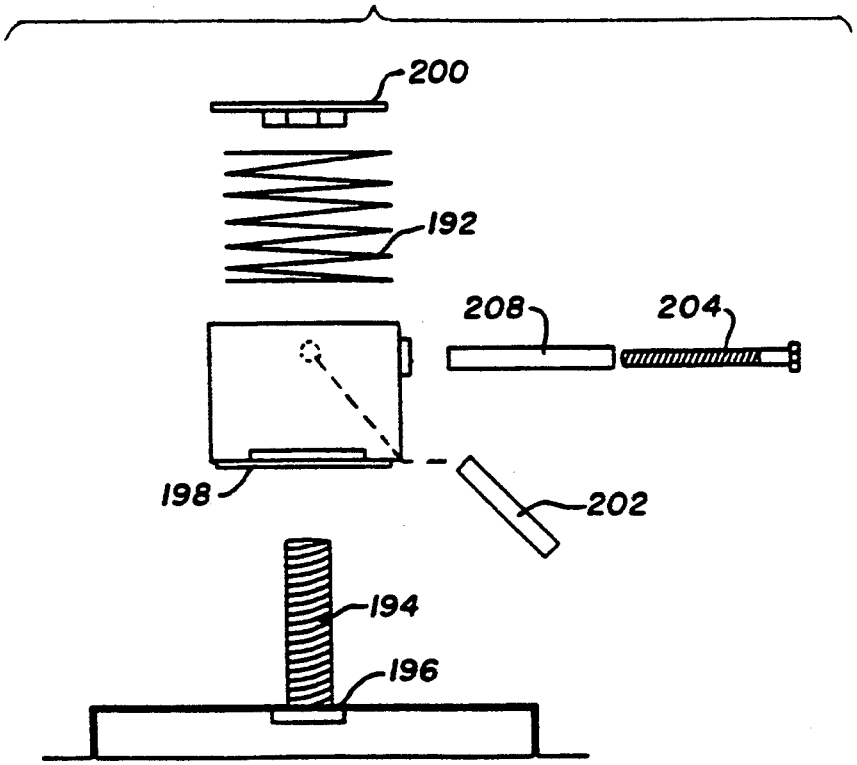

Door attachment devices 186 are shown in FIG. 10 and also shown in FIGS. 13 and 13A. There is a sheet metal casing 198 that fits in an outer casing 190 and retaining a spring 192 and latch-retaining bolt 194. This bolt is welded in position at 196. The housing has a base washer 198 welded in position and the bolt 194 extends through it. Nut 200 is screwed against the tension of the spring 192 to provide a retaining force on an arm 202. A hardened steel pin 204 forms a groove 206 to expose a catch area for the door latch. A sleeve 200 receives the pin 204 and is secured and locked in place by the bolt. This member becomes a handle for securing and releasing the combustion door assembly as shown in FIG. 2. To operate the door securing mechanism, it is simply necessary to rotate the handles counter clockwise to free and enable removal of the door. This arrangement, particularly the use of the springs 192, allows for equalization of the pressure as the door is forced back and forth. The resilient mechanism ensures that the compression acts equally and uniformly on the entire surface of the door.

Figure 14:
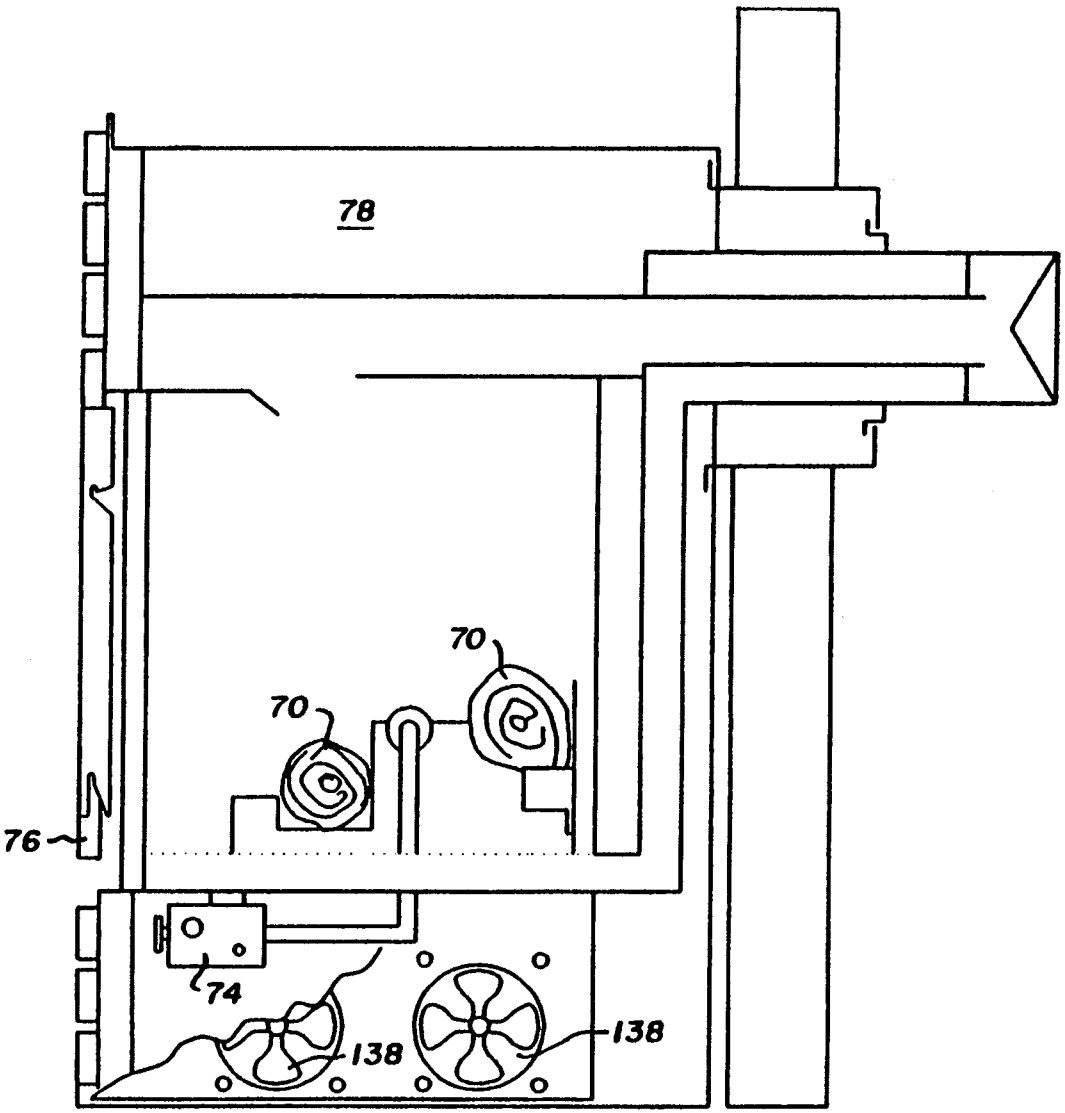
FIG. 14 is a sectional side elevation of a preferred feature of the invention.
Figure 14:
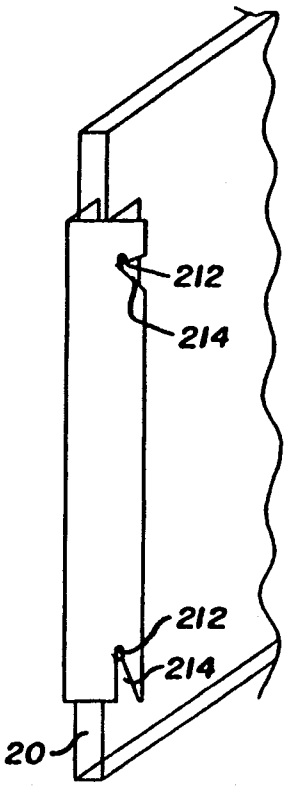

A particularly desirable feature of the door structure is illustrated in FIG. 6 and 14 where an additional, outer safety structure 210 is shown. Hooks 212 are provided on the fireplace door assembly and there are aligning slots 214 in the door frame. The outer glass screen acts as a thermo barrier, particularly in a house with young children. Furthermore, a channel is defined between the door and the protective screen so that a convention current of air is forced up, act to cool the door and to warm the room air. A further feature of this arrangement is that in the event of an explosion the outer glass acts as a protection against splinters.

Figure 4:
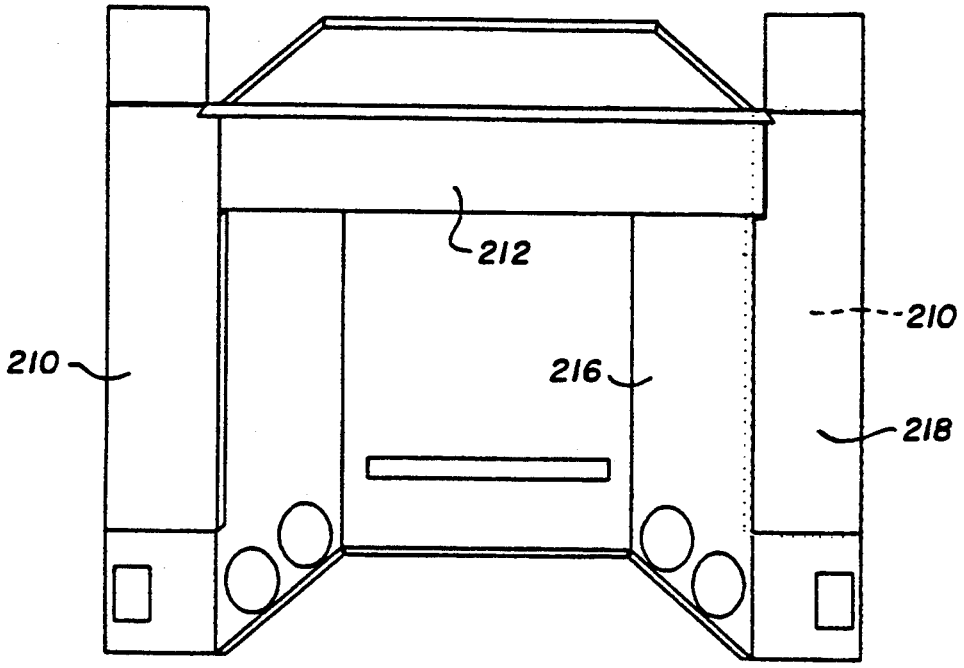
FIG. 4 shows a detail of the gas fireplace of the present invention.
Figure 4A:
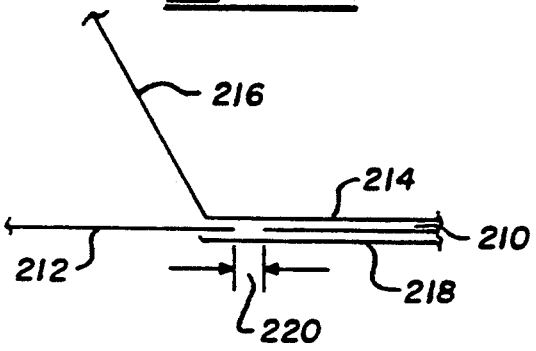
FIGS. 4A and 4B are details of FIG. 4.
Figure 4B:
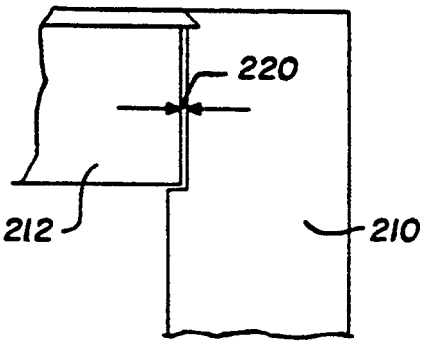

FIGS. 4, 4A and 4B illustrate an aspect of the invention that prevents the banging and cracking that can be a feature with prior art fireplaces. This noise in operation is, of course, due to expansion and contraction with the considerable heat developed in the gas fireplace. As shown in FIGS. 4 to 4B the present invention has a first plate 210 attached to a top plate 212. The first plate 210 is a sliding fit against upstanding front wall pieces 214 which are attached rigidly to the side walls 216 of the insert. Plate 218—see FIG. 4A—fits over plates 210 and 212 on the front and is spot welded to plate 210.

An expansion joint is thus formed at each upper corner, allowing the inner combustion chamber to move freely as a result of expansion and contraction due to the gap 220.

I claim:

1. A gas fireplace comprising:

a housing located in a building;

a first conduit extending from outside the building into the housing and comprising a cylinder having first and second groups of longitudinal openings at its outer end;

a fireplace insert received in the housing;

a second conduit in the fireplace insert alignable with and received by the first conduit, the first and second conduits being dimensioned so that the second conduit extends to a point between the two groups of longitudinal openings of the first conduit;

a gasket located between the first conduit and the second conduit and contacting the first conduit between the two groups of longitudinal openings;

a generally conical closure for the first conduit located in the end of the first conduit to seal the end of the first conduit and extending into the first conduit to a point adjacent the end of the second conduit, the gasket and conical enclosure cooperating to define an annular air inlet extending from the second group of openings in the first conduit between the first and second conduits and an exhaust outlet in the second conduit extending to the first group of openings in the first conduit, the conical closure acting to deflect exhaust gases from the second conduit through the second openings;

the housing being located independently of the fireplace insert initially and the fireplace insert being inserted subsequently by alignment of the second conduit within the first conduit, the first conduit and the gasket co-operating to guide and control movement of the second conduit thereby guiding insertion of the insert within the housing.

2. A gas fireplace as claimed in claim 1 including a flat end piece for the generally conical closure.

3. A gas fireplace as claimed in claim 1 in which the insert includes means to support artificial logs, a gas burner having means to improve gas flame appearance, an ignition system, a removable door and a heat exchanger whereby room air can exchange heat with combustion products.

4. A gas fireplace as claimed in claim 3 in which the means to improve gas flame appearance comprises an elongated bar curving around the gas burner and having openings along its upper edge.

5. A gas fireplace as claimed in claim 3 including an outer door, spaced from the removable door, and means to hold the outer door in position.

6. A gas fireplace as claimed in claim 5 in which the outer door is provided with pins;

recesses in the housing to receive the pins.

7. A gas fireplace as claimed in claim 3 including means to vary flame pattern.

8. A gas fireplace as claimed in claim 7 in which the means to vary flame pattern comprises means to vary the gas supply to the burner.

9. A gas fireplace as claimed in claim 7 in which the means to vary the gas supply comprises a valve body having an inlet and an outlet;

first, second, third and fourth chambers in the valve body;

an air bleed from the fourth chamber;

a diaphragm between the third and fourth chambers;

a constant gas feed from the second chamber to the first chamber to the gas outlet;

a gas bleed from the third chamber to the gas outlet;

a first opening between the first and second chamber;

a second opening between the second and third chamber;

a valve stem mounted on the diaphragm and extending through the first and second openings;

a flange at the distal end of the stem and first and second valve members on the stem, the first valve member to control the first opening and the second valve member to control the second opening;

resilient means urging the first and second valve members apart whereby there is a constant gas flow from the second chamber to the first chamber to the outlet to maintain a gas flame, gas pressure build-up acting to raise the diaphragm to raise the valve stem to raise the second valve member to close the second opening, the valve flange acting to raise the first valve member to allow gas to pass from the second to the first chamber through the first opening to increase gas flow to the first chamber, to the outlet to increase flame height, gas bleeding from the third chamber through the gas bleed reducing pressure in the third chamber whereby the diaphragm moves downwardly to open the first opening and close the second for a low flame condition.

10. A gas fireplace as claimed in claim 9 in which the air bleeding includes a control valve.

* * * * *